US005400528A

United States Patent [19]

Skinner et al.

[11] Patent Number: 5,400,528

[45] Date of Patent: Mar. 28, 1995

[54] ADJUSTABLE ARCH, CUSHION INSOLE FOR A SHOE

[75] Inventors: Michael H. Skinner, Yardley, Pa.; Sean Mannix, Hopewell, N.J.; James M. Cormier, Yardley; Irwin J. Katzmann, II, Newtown, both of Pa.

[73] Assignee: Prince Sports Group, Inc., Bordentown, N.J.

[21] Appl. No.: 122,026

[22] Filed: Sep. 15, 1993

[51] Int. Cl.[6] ..... A43B 13/38; A61F 5/14

[52] U.S. Cl. ..... 36/161; 36/160; 36/145; 36/44

[58] Field of Search ..... 36/160, 161, 162, 163, 36/164, 165, 145, 155, 44, 71

[56] References Cited

U.S. PATENT DOCUMENTS

| | | | |
|---|---|---|---|
| 1,061,353 | 5/1913 | Block | 36/163 |
| 1,583,682 | 5/1926 | Grant | 36/161 |
| 2,075,942 | 4/1937 | Howell | 36/161 |
| 2,075,943 | 4/1937 | Howell | 36/161 |
| 2,193,174 | 3/1940 | Knupp | 36/162 |
| 2,311,925 | 2/1943 | Boos | 36/163 |
| 2,599,589 | 6/1952 | Silverman et al. | 36/160 |
| 3,586,003 | 6/1971 | Baker | 36/145 |
| 4,841,648 | 6/1989 | Shaffer et al. | 36/145 |

FOREIGN PATENT DOCUMENTS

| | | | |
|---|---|---|---|
| 497328 | 11/1953 | Canada | 36/155 |

*Primary Examiner*—Steven N. Meyers
*Attorney, Agent, or Firm*—White & Case

[57] ABSTRACT

A cushion insole for a shoe comprises a cushion insole member and a separate arch support member which may be secured to the insole member or shoe foundation and which includes an arch support section bearing against the arch of the foot. The arch support member is available in various sizes to conform to the arch of the foot of the individual user, and may be secured to the insole member or shoe foundation at adjustable locations. An appropriate size arch support member and insole member are inserted into the shoe, with the arch support member positioned at the desired location relative to the arch of the foot, whereafter the shoe is worn in the normal manner.

4 Claims, 4 Drawing Sheets

ADJUSTABLE ARCH, CUSHION INSOLE FOR A SHOE

FIELD OF INVENTION

The present invention relates to shoes, and in particular to sports shoes of the type having a removable cushion insole.

BACKGROUND OF THE INVENTION

Today's sports shoes typically include an upper and a molded rubber or polyurethane outsole. In one widely used construction of a tennis shoe, the shoe upper is adhered to an insole piece of tough artificial soling material, such as materials sold under the name Texon or Bontex, and thereafter the outsole is affixed to the insole and upper, such as by adhesion or stitches. The Texon or Bontex insole pieces are flat, which greatly facilitates the manufacturing of the shoe. But, because the inside of the shoe thus formed is also flat, and made of a relatively hard insole material, an additional cushion insole is inserted into the shoe after manufacture. The cushion insole is not adhered to the shoe insole, but rather may be removed and replaced as desired.

In addition to providing cushioning for the feet, cushion insoles used in sports shoes are normally contoured in the heel and arch, in order to conform generally to the shape of the bottom of the foot.

While the cushion insole does make the shoe more comfortable, different feet have different shape arches, and thus the cushion insole described above cannot provide optimal arch support for everyone. It would thus be desirable to improve the arch support provided by present day cushion insoles. It would further be desirable to improve arch support in a cost effective manner, and with a device which is easy to use.

SUMMARY OF THE INVENTION

The present invention is a cushion insole for a shoe having an adjustable arch support which may be customized for individual use. The adjustable insole is easy to use and inexpensive to manufacture.

More particularly, a cushion insole according to the invention comprises an insole member and a separate arch support member that is available in different sizes. Preferably, the arch support member is capable of being readily secured to the insole member, but alternatively means are provided to secure the arch support member to the shoe itself. The arch support member has a first, generally planar section and an arch support section extending from the planar section at an angle thereto. Means are provided for securing the arch support member to the insole member or shoe such that the planar section lies generally flat against the lower surface of the insole member and the arch support section extends upwardly so as to be positioned, when the cushion insole is disposed in a shoe, to bear against the arch of the foot.

Arch support members may be provided having arch support sections varying in thicknesses. By thus providing a range of sizes, the user is thus able to select an arch support member which will provide the desired amount of arch support. The selected arch support member is then secured to the insole member, and positioned inside the shoe.

In addition to providing arch support members of different sizes, preferably, the securing means allows the position of the arch support member to be adjusted within the shoe both in the lengthwise and widthwise directions, to allow the arch support section to be positioned at the desired location relative to the individual's arch.

In a preferred embodiment, the insole member includes a conventional contoured arch portion. The arch support section of the arch support member is arranged to bear against the contoured arch portion so as to act in conjunction with the insole member in providing arch support.

Preferably, the means for securing the arch support member to the insole member comprises a plurality of projecting members on either the insole member or the arch support member. The other member includes a plurality of holes for receiving the projecting members.

In order to provide adjustable thickness, the arch support section preferably comprises a support plate forming an extension of the planar section, and a cushion pad of selected thickness which is secured to the plate.

In the embodiment where the arch support member is secured to the insole member, the insole member includes a seat area on its lower surface, a portion of which includes an array of downwardly projecting studs, for receiving the arch support member. The planar section of the arch support member includes a plurality of holes having relative spacing to receive some or all of the studs, such that the planar section may be seated in the seat area to receive a plurality of studs and lie generally flush with the lower surface. Most preferably, the studs and holes are uniformly spaced such that the arch support member may be secured to the insole member at a plurality of positions. In the embodiment where the arch support member is secured to the shoe, the stud array may be formed on the upper surface of the shoe foundation.

If desired, a stud array may be formed in the arch support member, and a cooperating hole array is provided in either the insole member or the shoe interior for securing the arch support member. In addition, other securing means may be employed between the arch support member and the insole member or shoe.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
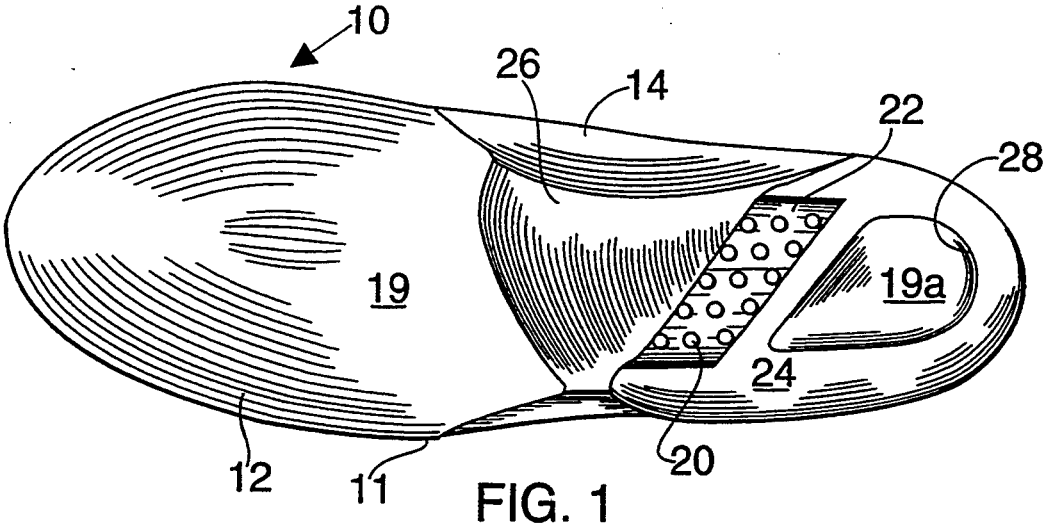
FIGS. 1 and 2 are bottom and side views, respectively, of a shoe insole member according to the invention.
Figure 2:
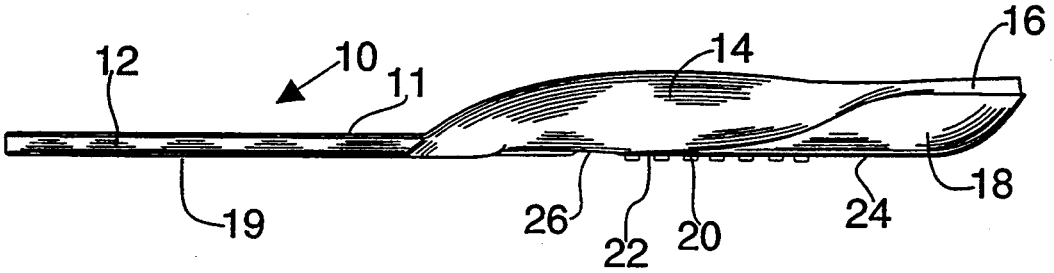
Figure 3:
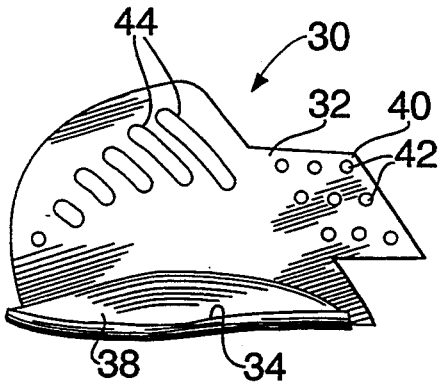
FIGS. 3 and 4 are top and bottom views, respectively, of an arch support member for use with the shoe insole member of FIGS. 1 and 2.
Figure 4:
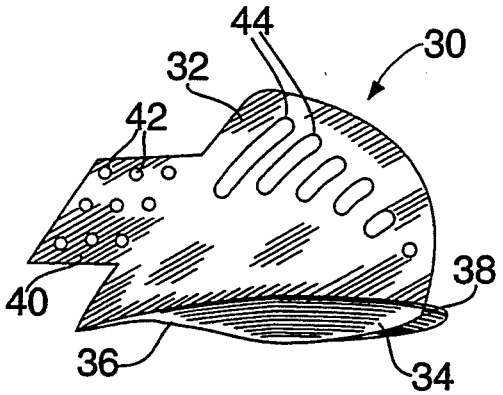
Figure 5:
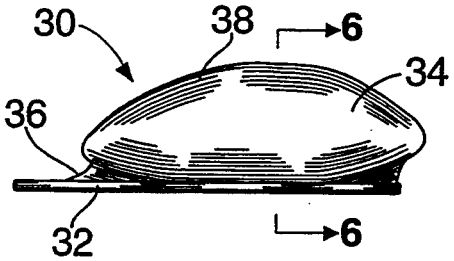
FIG. 5 is a front view of the arch support member.

A cushion insole according to the invention includes an insole member 10 and an arch support member 30. As shown in FIGS. 1–2, the insole member 10 includes a body 11 which has the general configuration of a conventional sports shoe cushion insole, with a generally flat sole portion 12, a contoured arch portion 14, and a contoured heel portion 16. The insole body 11 is preferably made of a cushion material, and may be formed in accordance with known constructions, for example, a resilient foam body covered by an upper felt layer.

A plastic shell 18 is secured to the lower surface 19 of the insole member body 11 in the heel area. The shell 18 has an array of studs 20 which are evenly spaced from one another. The studs 20 are arranged on a landing 22 which is located just behind the contoured arch portion 14 and which is indented from the lower surface 24 of the shell 18. The lower surface of the insole member body 11 also includes an indented area 26 which is elevated above the lower surface 19 and situated below the contoured arch portion 14. Together, the landing 22 and indented area 26 form a seat for the arch support member, as described below. Also, as shown in FIG. 1, preferably the shell 18 includes a cutout 28 below the heel, into which a portion **19*a* of the resilient insole member body 11 extends to be flush with the lower surface 24 of the shell 18**.

The shell 18 and insole member body 11 are preferably molded separately, and then secured permanently together using adhesive. The interfitting cutout 28 and downwardly extending body portion **19*a*** act to further retain the parts together.

Figure 6:
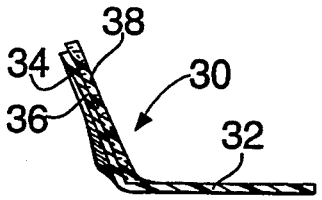
FIG. 6 is a sectional view of the arch support member, taken through lines 6—6 of FIG. 5.

Referring to FIGS. 3–6, the arch support member 30 includes a generally planar section 32 and an arch support section 34 which extends from the planar section 32 at an angle thereto (see FIG. 6). The arch support section 34 includes a support plate 36 which is an angled extension of the planar section 32, and a resilient cushion pad 38 made, e.g., of foam, adhered thereto. The support plate 36 and pad 38 are of general convex shape, when viewed in the direction of FIG. 5, i.e., and in particular are a mirror image of the general shape of the arch of the foot.

The planar section 32 includes a support tab 40 which is formed with an array of holes 42 therein. The holes 42 are arranged with the same pattern and spacing as the studs 20 of the shell 18, although for reasons described below there are fewer rows of holes than there are rows of studs. Also, preferably a plurality of cutouts 44 are formed in the planar section 32 to reduce weight.

Figure 7:
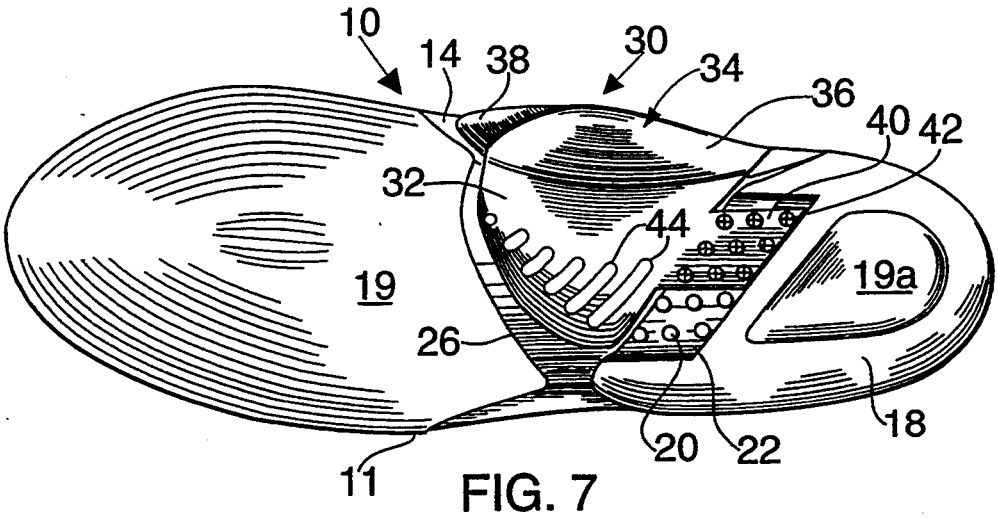
FIGS. 7 and 8 are bottom and side views, respectively, of the shoe insole member with the arch support member secured thereto at a first location.
Figure 8:
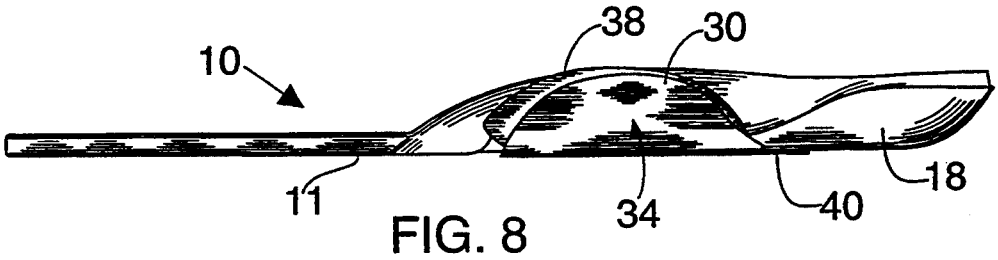

Referring to FIGS. 7–8, the arch support member 30 is secured to the insole member 10 by positioning the planar portion 32 and tab 40 so as to be seated in the indented area 26 of the insole body 11 and landing 22, respectively. The holes 42 are aligned with and pressed onto a respective array of studs 20, and preferably the studs and holes are sized so that the arch support member 30 and insole body 11 snap together. As mounted, the upper surface of the planar section 32 bears against the lower surface of the insole body 11 and the cushion 38 is held against the contoured arch portion 14 by support plate 36. Because the indented area 26 and landing 22 are elevated above the lower surfaces 19, **19*a*, and 24 of the insole body 11 and shell 18, when the arch support member 30 is secured to the insole body 11 its lower surface will be generally flush with the surfaces 19, 19*a*, 24, as shown in FIG. 8**.

As shown in FIG. 7, the landing 22 is larger than the area of the tab 40, and there are two rows of unused studs 20. The position of the arch support member 30 is thus adjustable. If desired, the arch support member can be shifted toward the center of the insole body 11, such that the holes in tab 40 engage successive rows of studs 20, thus moving the arch support plate 36 and cushion 38 inwardly to tighten the arch area. Also, if desired the arch support member can be moved forward, e.g., by one row of holes.

In this manner, in accordance with the arch support system of the invention, the location of the studs, and thereby the general location of the arch support member within the shoe, is based upon the size of the insole member (or shoe). However, because the securing means (e.g., post and holes) allows the position of the arch support member to be adjusted, the arch support member can be moved both axially and laterally to position the pad 38 at the optimal location for the individual foot.

Figure 9:
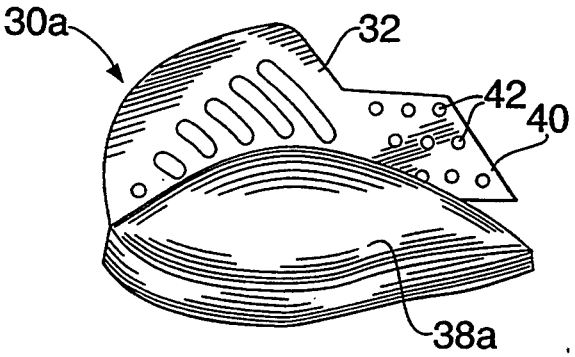
FIG. 9 is a top view of a second arch support member which may be used interchangeably with the arch support member of FIGS. 3–6.

FIG. 9 shows a second arch support member **30*a*. The arch support member 30*a* in FIG. 9 is generally the same as the arch support member 30 of FIGS. 3–6, except that the cushion pad 38*a* is thicker and optionally larger. However, the planar section 32, tab 40, and hole array 42 are the same as in FIGS. 3–6, so that the arch support member 30*a* is interchangeable with arch support member 30 for use with the insole body 11**.

Figure 10:
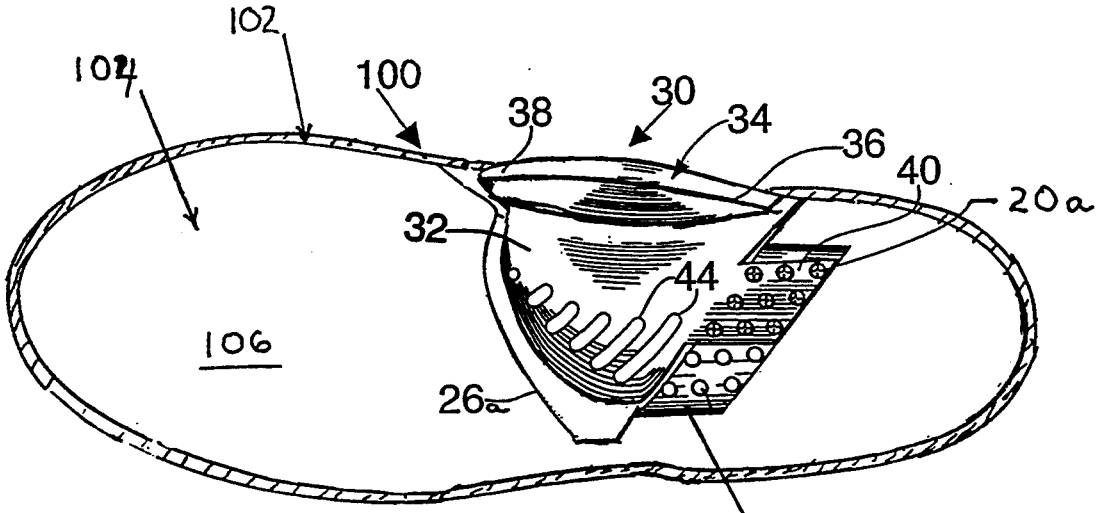
FIG. 10 is a top, sectional view of a shoe, illustrating an alternative arch support system.

FIG. 10 illustrates a shoe 100, in which the upper 102 has been cut away to illustrate the shoe interior 104. The shoe includes a foundation, which may include an outsole secured to a piece of soling material, having a flat upper surface 106. The foundation may be formed in any conventional manner, except that the soling material upper surface 106 is provided with an indented area **26*a*, landing 22*a*, and studs 20*a*, which are comparable to portions 20, 22, and 26 in FIGS. 1–2**.

In this manner, as shown in FIG. 10, an arch support member 30 can be inserted inside the shoe 100, and snapped onto the studs 20 at any of several desired locations, with the arch support section 34 extending up into the shoe in the arch area. A conventional insole member (i.e., without studs) may then be slipped inside the shoe.

In accordance with the present invention, shoes are provided, in addition to the appropriate size insole member 10, with arch support members 30, **30*a*** of various sizes (e.g., differing pad thicknesses). Different size arch support members may be packaged together with the shoes when sold, or may be available separately at the retailer. When the shoes are purchased, the user then selects the appropriate size arch support member, and secures it to the insole member or shoe foundation at the desired stud location. Because the arch support member is releasably secured to the studs, the user may try out different size arch support members and locations, and thus select the appropriate configuration by trial and error. Once the correct arch support member and location have been selected, if desired, the arch support member may be permanently secured to the insole member or shoe foundation using, e.g., an adhesive.

In the foregoing embodiments, the arch support member was provided with holes, which engage cooperating studs or posts on the insole member or shoe foundation. Alternatively, the arch support member may be provided with an array of studs that engage cooperating holes in the insole member or shoe. Moreover, while a post-and-hole, snap-together system has been illustrated to secure the arch support member to the insole body or shoe foundation, other means may be used to secure the two members together, such as a sliding mechanism or adhesive.

The foregoing represents a preferred embodiment of the invention. Variations and modifications will be apparent to persons skilled in the art, without departing from the inventive concepts disclosed herein. While arch support members of two different sizes have been shown to illustrate the principles of the invention, preferably at least three sizes are available, corresponding to low, medium, and high arches. Also, when providing the user with a choice of arch support members, in addition to varying the thickness of the arch support section (cushion pad), the angle of the arch support plate may be varied, the size of the cushion pad may be varied, the resilience or composition of the pad may be varied, or the shape of the pad may be varied. All such modifications and variations are intended to be within the skill of the art, as defined in the following claims.

I claim:

1. A cushion insole system for insertion into a shoe interior comprising:

an insole member having upper and lower surfaces, a cushion body including sole and heel areas and a contoured arch portion, and a shell secured to said body in said heel area; wherein said shell includes a landing containing an array of downwardly projecting studs;

an arch support member having a first, generally planar section which includes a tab containing a plurality of holes having relative spacing to receive a plurality of said studs and which tab is sized to be seated in said landing so that said planar section lies generally flush with said lower surface, and an arch support section extending from said planar section at an angle thereto, wherein said arch support section bears against the contoured arch portion of said insole member and comprises a support plate forming an extension of said planar section and a cushion pad of selected thickness secured to said plate, and wherein said studs and holes are uniformly spaced such that said arch support member may be secured to said insole member at a plurality of positions.

2. A cushion insole system according to claim 1, wherein said insole member has a longitudinal axis, and wherein said holes are arranged in an array such that the position at which said tab engages said landing can be adjusted both axially and widthwise.

3. A method for customizing a shoe having a shoe interior, comprising the steps of:

providing an insole member having upper and lower surfaces;

providing a plurality of arch support members of different sizes, wherein each arch support member has a first, generally planar section and an arch support section extending from said planar section at an angle thereto, and wherein each said arch support member comprises a support plate forming an extension of said planar section and a cushion pad secured to said plate;

selecting an arch support member of desired size for insertion into said shoe, wherein the selected arch support member has a cushion pad of selected thickness to provide a desired amount of arch support; and inserting said arch support member and insole member into said shoe interior and securing said arch support member in a selected location within said shoe interior, utilizing a securing means, such that said planar section lies generally flat against said lower surface and said arch support section extends upwardly to bear against the arch of the foot.

4. A method according to claim 3, comprising the step of adjusting the position of said selected arch support member within said shoe, and securing said member at the desired position.

* * * * *